US006705975B2

(12) United States Patent
Kuo

(10) Patent No.: US 6,705,975 B2
(45) Date of Patent: Mar. 16, 2004

(54) FOOT STEPPER EXERCISE MACHINE

(76) Inventor: Cheng-Tzu Kuo, 7F-1, No. 115, Sec. 4, Jen-Ai Rd., Taipei (TW)

( * ) Notice: Subject to any disclaimer, the term of this patent is extended or adjusted under 35 U.S.C. 154(b) by 181 days.

(21) Appl. No.: 09/987,288

(22) Filed: Nov. 14, 2001

(65) Prior Publication Data

US 2003/0092538 A1 May 15, 2003

(51) Int. Cl.[7] ..... A63B 23/08
(52) U.S. Cl. ..... 482/79; 482/80; 482/51; 482/52
(58) Field of Search ..... 482/51–53, 80, 482/112, 79, 113

(56) References Cited

U.S. PATENT DOCUMENTS 4,279,415 A * 7/1981 Katz
4,563,001 A * 1/1986 Terauds
5,256,118 A * 10/1993 Chen
5,346,444 A * 9/1994 Hsieh
6,024,678 A * 2/2000 Solomon

* cited by examiner

*Primary Examiner*—Jerome W. Donnelly
(74) *Attorney, Agent, or Firm*—Bacon & Thomas

(57) ABSTRACT

A foot stepper exercise machine is composed of a base (10), two platform elements (20R, 20L) pivotally secured on the base (10), and two resilient elements (30) sandwiched between the base (10) and the corresponding platform elements respectively. The resilient elements (30) provide recoiling force for the platform elements (20R, 20L) and substitute mechanically hydraulic presses so that the structure of the foot stepper is simplified and a user is enabled to selectively operate the foot stepper in different ways while sitting.

11 Claims, 7 Drawing Sheets

FOOT STEPPER EXERCISE MACHINE

BACKGROUND OF THE INVENTION

1. Field of the Invention

The present invention relates to a foot stepper exercise machine, and more particularly to a foot stepper that can be operated while a user is sitting.

2. Description of Related Art

The market is replete with exercise machines designed to exercise various muscle groups in a human body, and a stepper is one of the popular exercise machines.

A conventional stepper as shown in FIG. 7 comprises a supporting frame (50), two treadles (60R, 60L) pivotally secured on the supporting frame (50), two hydraulic presses (55) secured under the corresponding treadles, and two spinning devices (65*a*, 65*b*) connecting between the supporting frame (50) and the treadles (60R/60L). The conventional stepper usually provides a form of aerobic exercises by simulating stair climbing. In such a machine, a user's body is repeatedly lifted by alternatively shifting the user's weight from one treadle to the other, each foot resting on its own treadle (60R/60L). As the weight is shifted to the treadle (60R/60L), the weight overcomes a resistive force from the hydraulic presses to move the treadle downward. In the conventional stepper, the treadles (60R/60L) are interconnected so that as one treadle (60R/60L) is pushed downward under the user's weight, the other treadle (60L/60R) is mechanically moved an equal distance in the opposite direction, i.e., upward. Repetitive stepping on and off by the user on each treadle (60R/60L) in a sinusoidal type reciprocating motion results in the aerobic exertion.

However, the conventional stepper has the following drawbacks:

1. When using the conventional stepper, the user has to stand on the treadles (60R, 60L) so as to put the body's weight thereon to make the stepper work. Therefore, the conventional stepper can not be used when the user is in a sitting position.
2. The conventional stepper usually has a complex structure, especially in the spinning devices (65*a*, 65*b*) for the treadles and other connecting devices between the spinning device (65*a*, 65*b*) and the supporting frame (50) or the treadles (60R/60L). Therefore, the conventional stepper is time-wasting in assembly and has a high product cost.

The present invention has arisen to mitigate and/or obviate the disadvantages of the conventional stepper.

SUMMARY OF THE INVENTION

The main objective of the present invention is to provide a foot stepper exercise machine that enables a user to use the foot stepper while sitting.

Another objective of the present invention is to provide a foot stepper exercise machine that has a simple structure.

Further benefits and advantages of the present invention will become apparent after a careful reading of the detailed description with appropriate reference to the accompanying drawings.

DETAILED DESCRIPTION OF THE INVENTION

Figure 1:
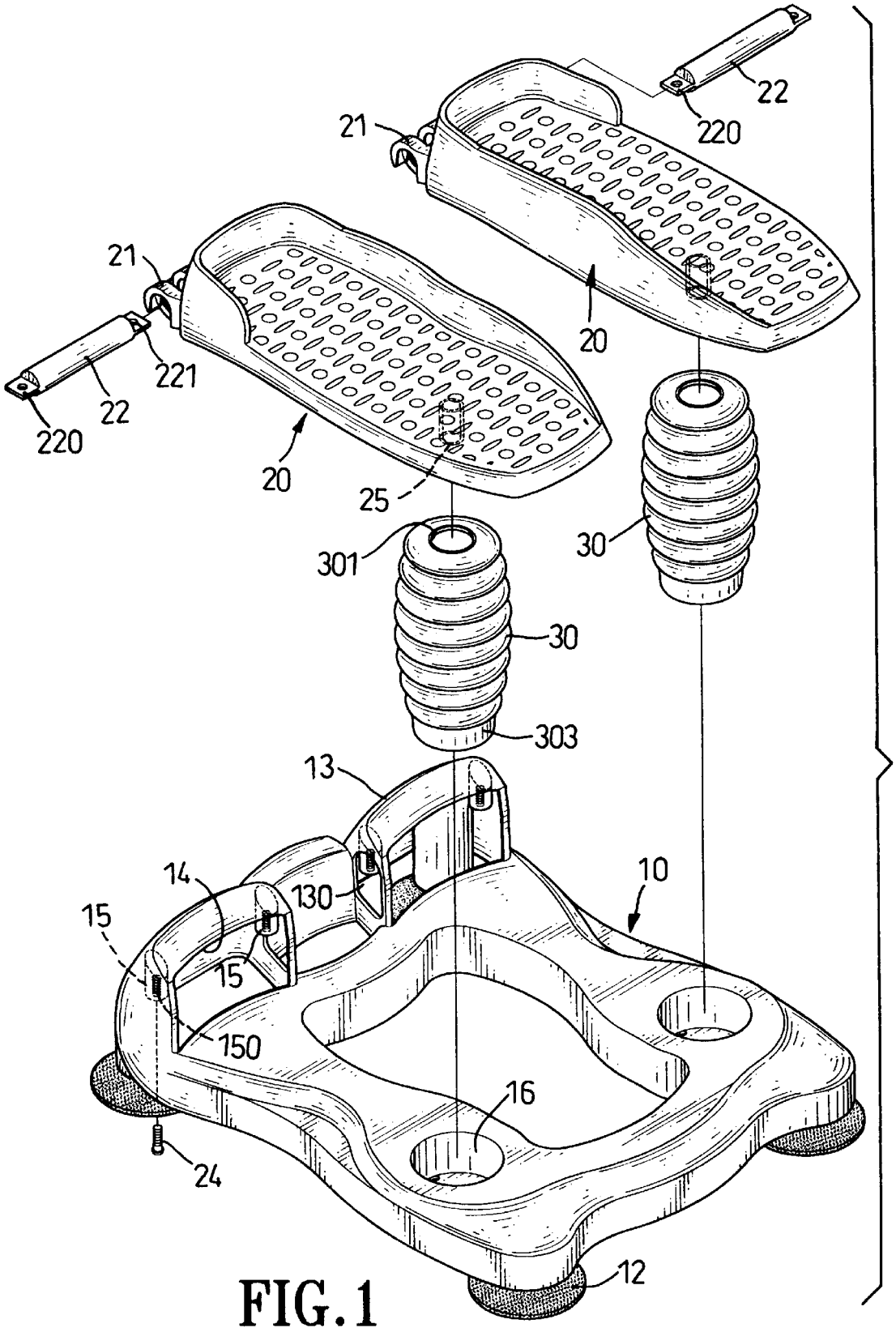
FIG. 1 is an exploded perspective view of a foot stepper exercise machine in accordance with the present invention.
Figure 2:
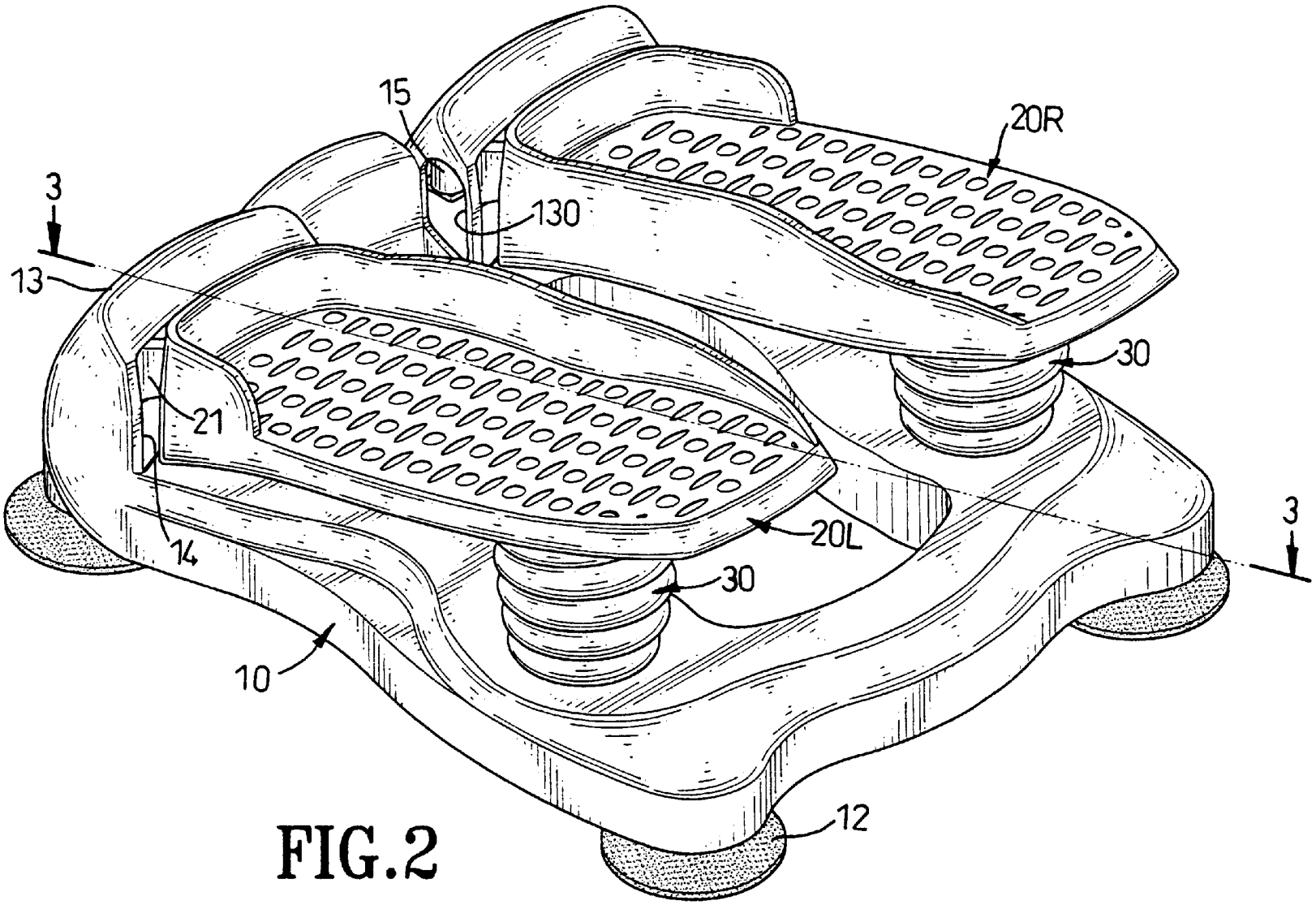
FIG. 2 is a perspective view of the foot stepper exercise machine in assembly in accordance with FIG. 1.
Figure 3:
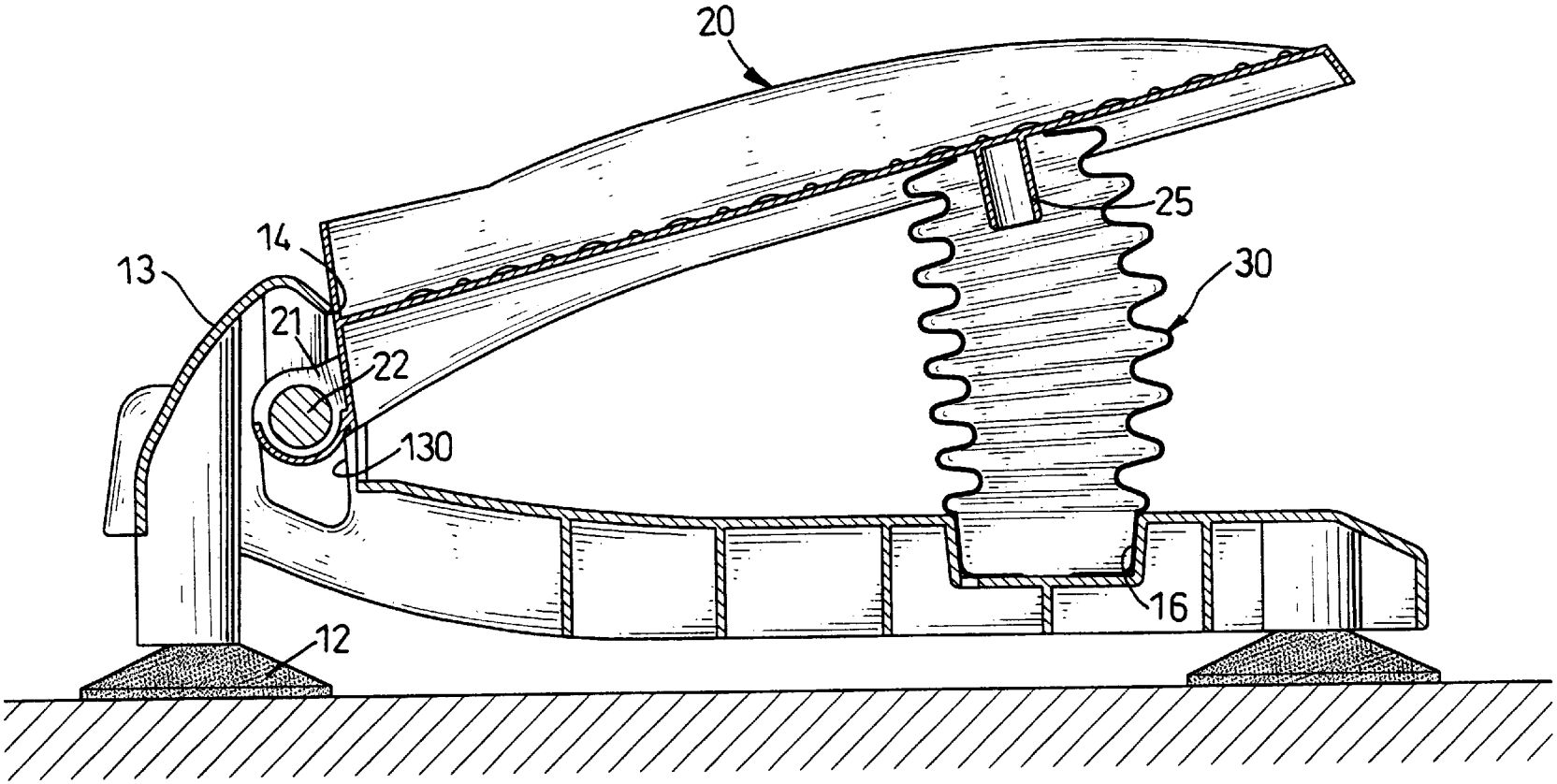
FIG. 3 is a cross-sectional side view of the foot stepper exercise machine in accordance with along line 3—3 in FIG. 2.

With reference to FIGS. 1, 2 and 3, a foot stepper exercise machine adapted to be operated for a user while sitting is disclosed, and the foot stepper comprises a base (10), two platform elements (20), and two resilient elements (30).

The base (10) is a substantially rectangular plate and has four floor-stationary components (12) respectively secured at four corners of the base (10), wherein the floor-stationary components (12) are sucking plates. Two pivot housings (13) are formed on a first end of the base (10) and each pivot housing (13) has an aperture (14) defined in an inner side face of the pivot housing (13) to receive the corresponding platform element (20R/20L) partially inside. Two fixing posts (15) are formed inside each pivot housing (13) and each fixing post (15) has a threaded hole (150) defined in a bottom face thereof. Two recesses (16) are oppositely defined in a second end of the base (10), and additionally, two through holes (130) are respectively defined in two side faces of the two pivot housings (13), wherein the two side faces are opposite with each other.

The two platform elements (20R, 20L), such as treadles, are adapted to accommodate feet of the user thereon and each platform element (20R/20L) has a pivot casing (21) secured on a first end. A pivot (22) is movably received inside the pivot casing (21) and has two connecting sheets (220) respectively formed at two distal ends of the pivot (22), wherein each connecting sheet (220) has a hole (221) defined therein. The connecting sheets (220) of the pivot (22) are secured on the corresponding fixing post (15) of the base (10) by screws (24) penetrating the hole (221) of the connecting sheet (220) to screw into the threaded hole (150) so as to enable the platform element (20R/20L) to pivotally move on the base (10). Additionally, each platform element (20R/20L) has a pin (25) attached on a bottom face of a second end of the platform element (20R/20L).

The resilient elements (30) are pleated tubes made of recoiling material and detachably clamped between the base (10) and the platform elements (20R, 20L). Each resilient element (30) has an opening (301) defined in a first end and secured on the corresponding platform element (20R/20L) by inserting the pin (25) of the platform element (20R/20L) into the opening (301) of the resilient element (30), i.e., the pleated tube. Each resilient element (30) has an insertion (303) formed on a second end and the insertion (303) is wedged into the corresponding recess (16) so as to secure the resilient element (30) on the base (10).

Figure 4:
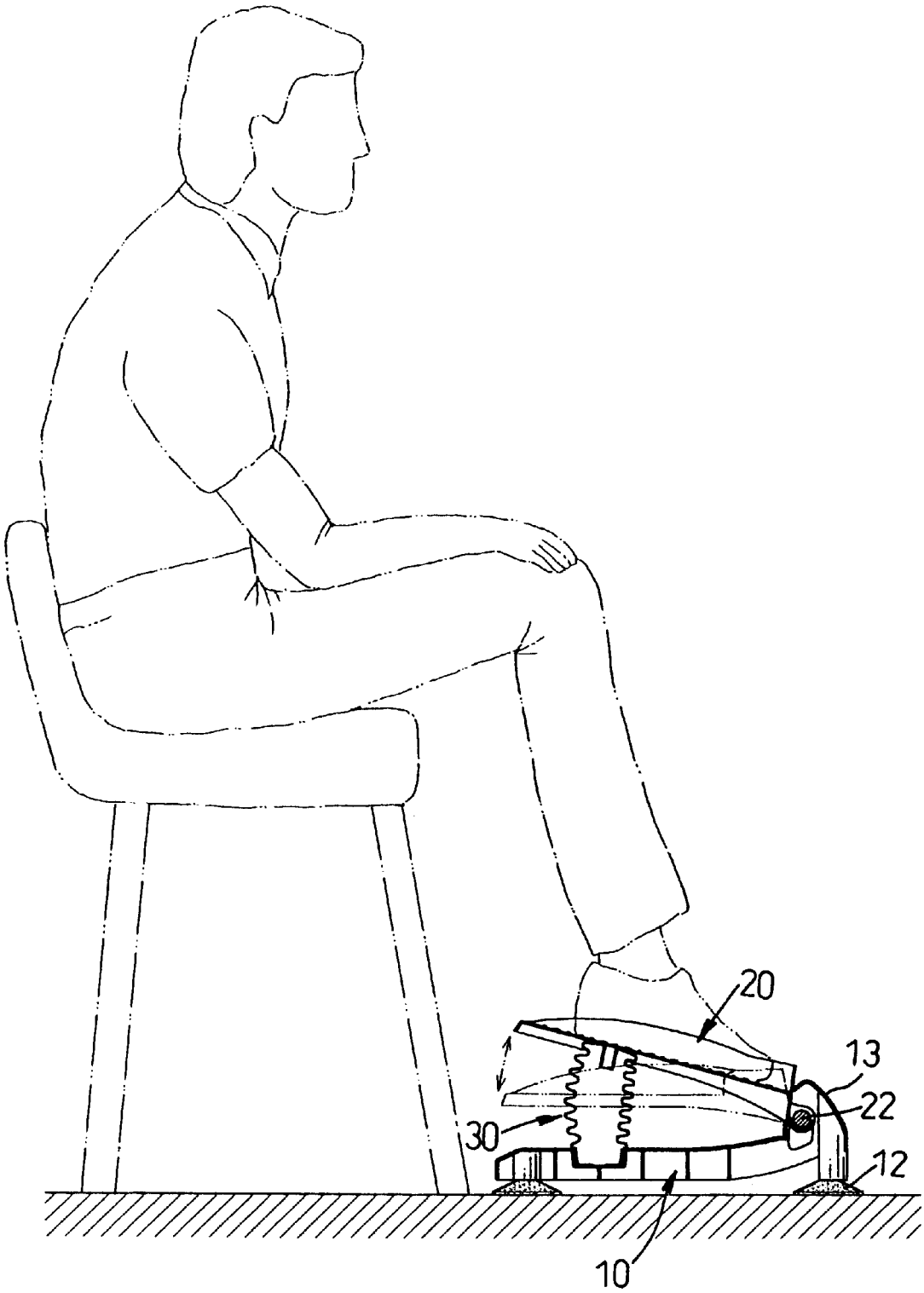
FIG. 4 is a schematic view of using the foot stepper exercise machine.
Figure 5:
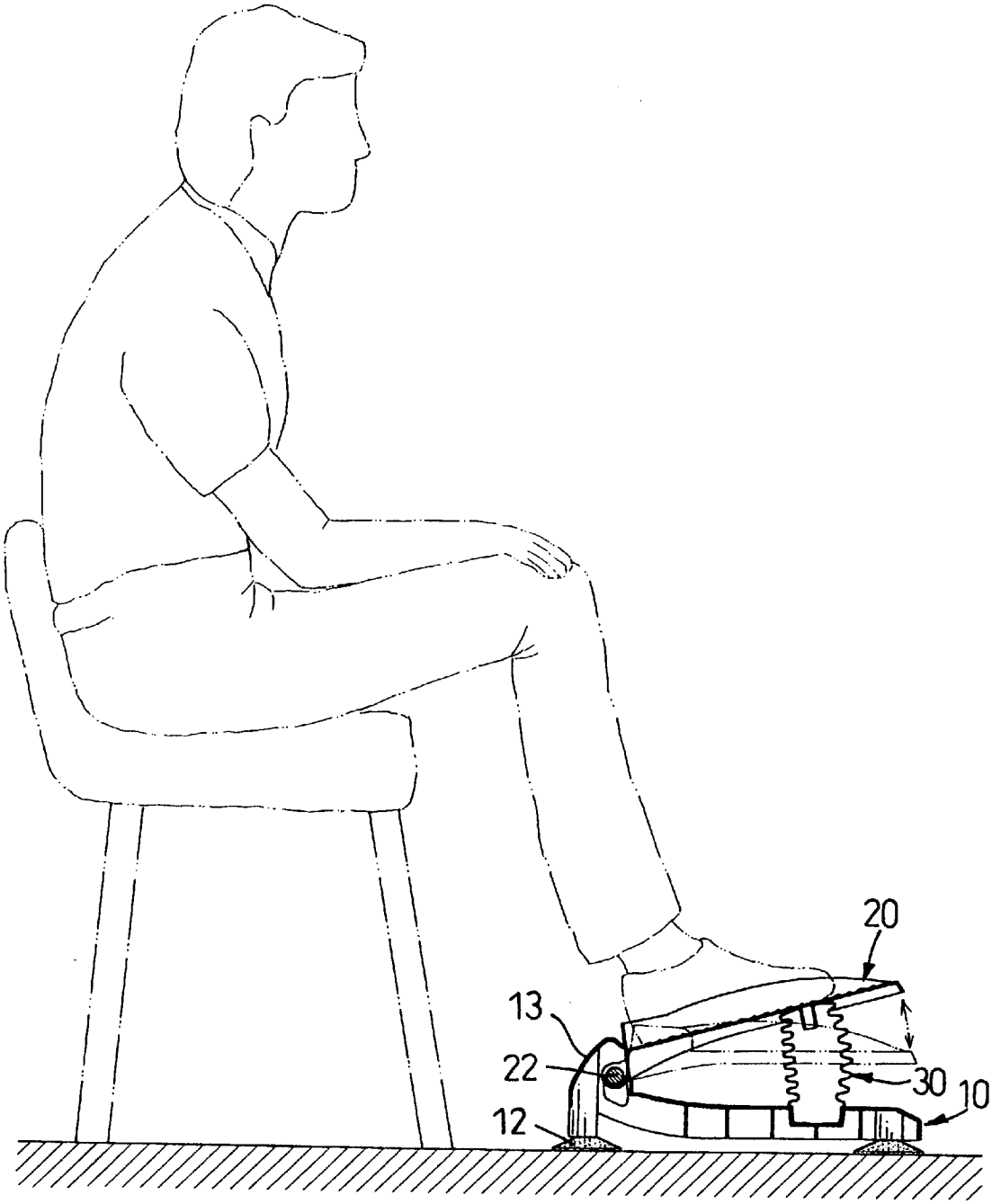
FIG. 5 is another schematic view of using the foot stepper exercise machine.

Because the resilient elements (30) are made of recoiling material, force for pressing the platform element (20R, 20L) is not as large as the hydraulic press of the conventional stepper. Therefore, the user does not need to stand up for using body weight to operate the foot stepper. As shown in FIGS. 4 and 5, the user sits on a chair or similar and steps against the corresponding platform elements (20R, 20L) of the foot stepper in a way of lifting the right foot or left foot alternatively in turn. Another way of operating the foot stepper is of two feet simultaneously stepping against the two platform elements (20R, 20L) or lifting at the same time. Additionally, no interconnection between the two platform elements (20R, 20L) results in a simple structure to achieve a low produce cost.

In FIG. 4, the user steps against the foot stepper, wherein toes of the feet are toward a direction to the pivot housing (13) of the base (10). In FIG. 5, the user steps the foot stepper, wherein the toes of the feet are toward to an opposite direction to the pivot housing (13) of the base (10).

Figure 6:
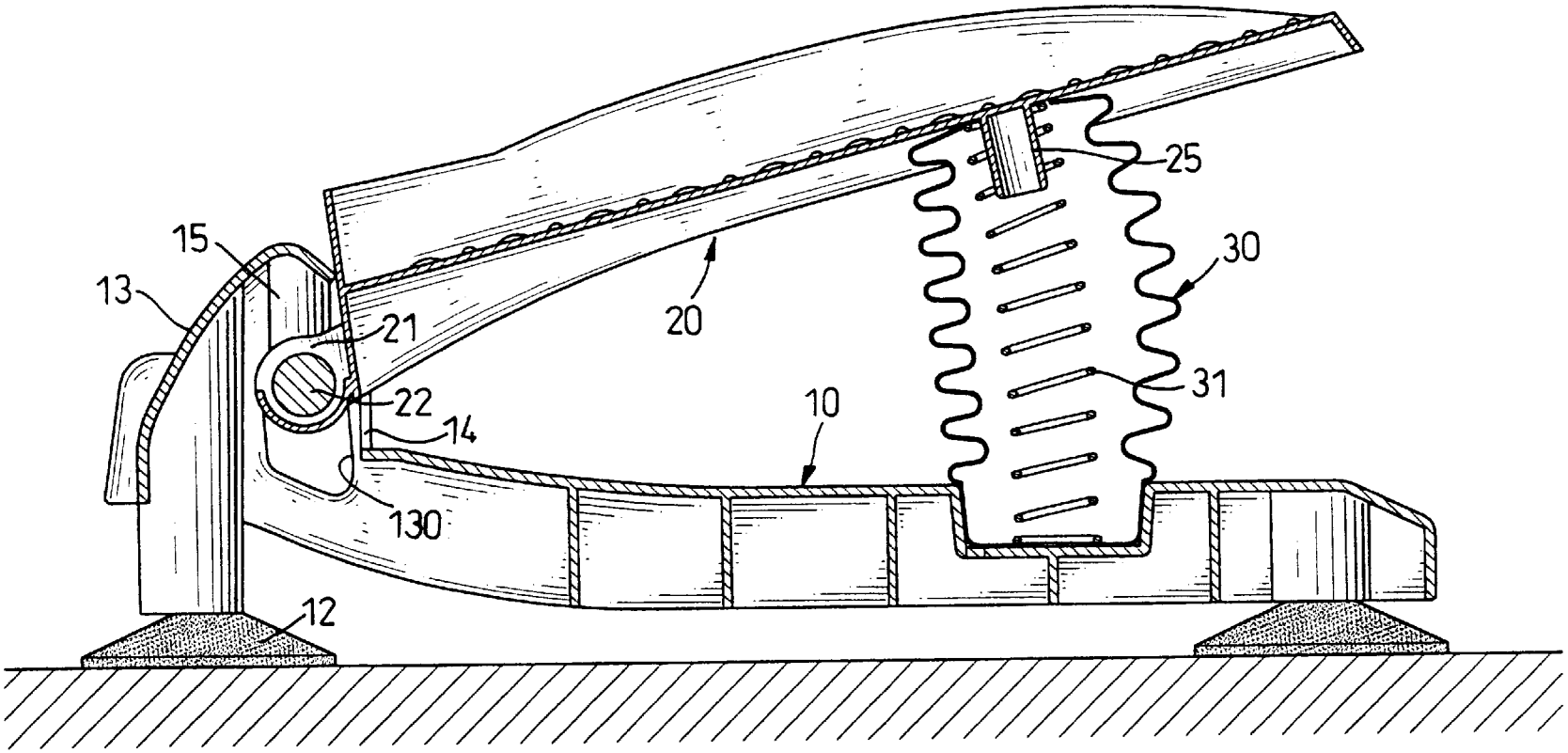
FIG. 6 is a side cross-sectional view of an embodiment of the foot stepper exercise machine.
Figure 7:
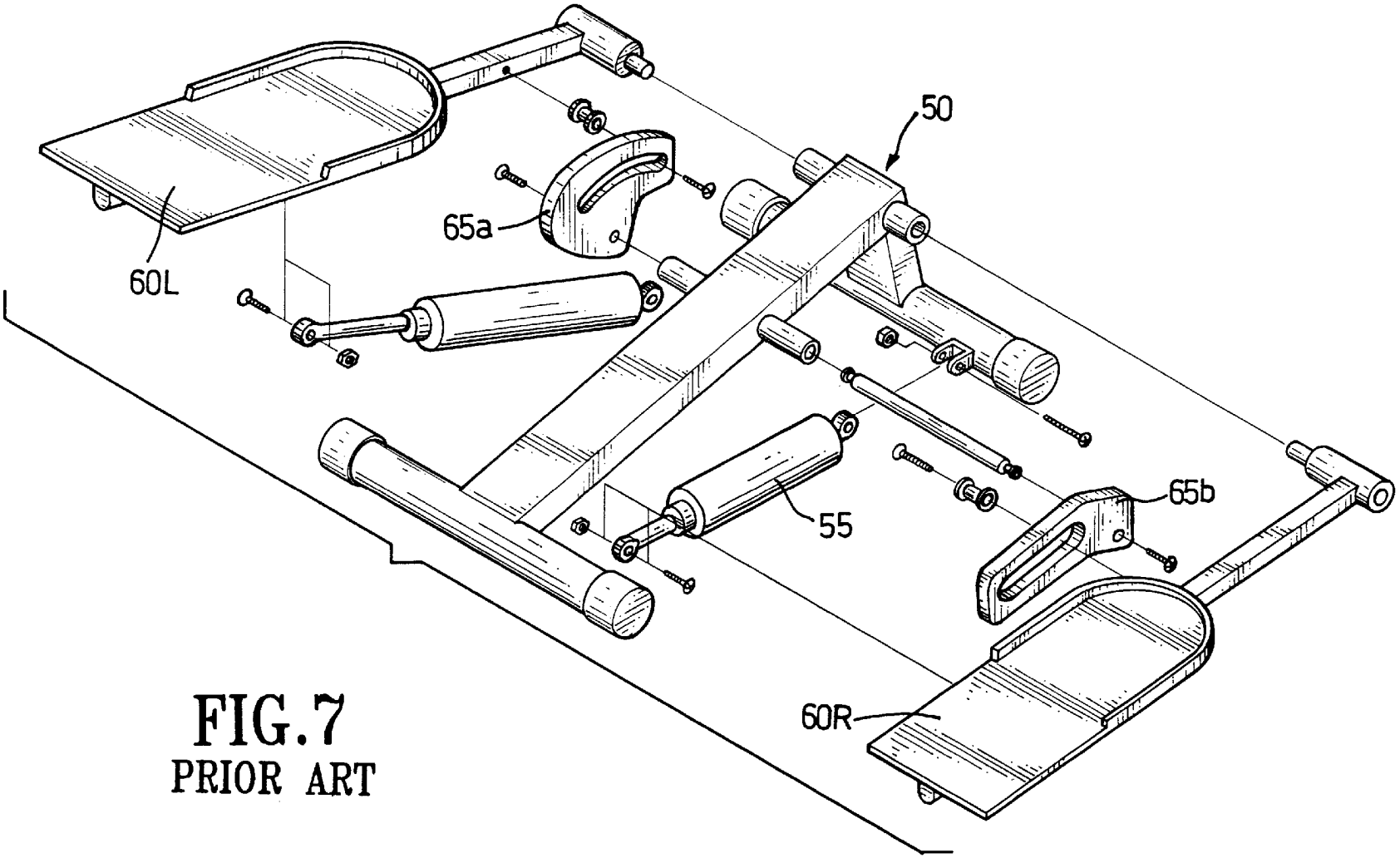
FIG. 7 PRIOR ART
FIG. 7 is an exploded perspective view of a conventional stepper.

With reference to FIG. 6, in a second embodiment the resilient element (30) further comprises a spring (31) inside. The spring (31) has a first end sleeving the pin (25) of the platform element (20R/20L) and a second end secured inside the recess (16) of the base (10) so as to provide a compressible effect for the foot stepper.

Although the invention has been explained in relation to its preferred embodiment, it is to be understood that many other possible modifications and variations can be made without departing from the spirit and scope of the invention as hereinafter claimed.

What is claimed is:

1. A foot stepper exercise machine comprising: a base (10) having two pivot housings (13) formed on a first end of the base (10);

two platform elements (20R, 20L) adapted to accommodate feet of a user on the platform elements (20R, 20L) and pivotally secured inside the pivot housing (13) of the base (10); and two resilient elements (30) clamped between the base (10) and the platform elements (20R, 20L) to provide a recoiling force for the platform elements (20R, 20L);

wherein each platform element (20R/20L) has a pivot casing (21) formed on the platform element (20R/20L) and a pivot (22) movably received inside the pivot casing (21), the pivot, (22) has two holes (220) respectively defined in two distal ends of the pivot (22); and each pivot housing (13) further has two fixing posts (15) formed inside the pivot housing (13), each fixing post (15) has a threaded hole (150) defined in the fixing post (15) and corresponding to one of the holes (220) on the pivot (22);

wherein the distal ends of each pivot (22) are respectively attached to the fixing posts (15) on a corresponding one of the pivot housings (13) by screws (24) extending through the holes (220) and screwing into the threaded holes (150).

2. The foot stepper as claimed in claim 1, wherein each platform element (20R/20L) has a pin (25) attached under the platform element (20R/20L); and each resilient element (30) has an opening (31) defined in the resilient element (30) to receive a corresponding one of the pin (25) so as to secure the resilient element (30) on the platform element (20R120L).

3. The foot stepper as claimed in claim 1, wherein the base has two recesses (16) defined in a second end of the base (10); and the two resilient elements (30) each has an insertion (303) formed on the resilient element (30) and wedged into a corresponding one of the respective recess (16) so as to secure the resilient elements (30) on the base (10).

4. The foot stepper as claimed in claim 2, wherein the base has two recesses (16) defined in a second end of the base (10); and the two resilient elements (30) each has an insertion (303) formed on the resilient element (30) and wedged into a corresponding one of the recess (16) so as to secure the resilient element (30) on the base (10).

5. The foot stepper as claimed in claim 1, wherein each resilient element (30) is a pleated tube made of recoiling material.

6. The foot stepper as claimed in claim 4, wherein each resilient element (30) is a pleated tube made of recoiling material.

7. The foot stepper as claimed in claim 6, wherein each pleated tube further receives a spring (31).

8. The foot stepper as claimed in claim 1, wherein each resilient element (30) is a spring.

9. The foot stepper as claimed in claim 1, wherein the base (10) further has multiple floor-stationary components (12) secured under the base (10) to firmly position the foot stepper.

10. The foot stepper as claimed in claim 5, wherein the base (10) further has multiple floor-stationary components (12) secured under the base (10) to firmly position the foot stepper.

11. The foot stepper as claimed in claim 7, wherein the base (10) further has multiple floor-stationary components (12) secured under the base (10) to firmly position the foot stepper.

* * * * *